United States Patent [19]

Seals

[11] Patent Number: 4,967,435

[45] Date of Patent: Nov. 6, 1990

[54] MULTIPURPOSE BICYCLE TOOL KIT

[76] Inventor: Robert L. Seals, 13524 Autumn La., Chico, Calif. 95926

[21] Appl. No.: 479,368

[22] Filed: Feb. 12, 1990

[51] Int. Cl.[5] ..... B25F 1/02; B25B 13/58

[52] U.S. Cl. ..... 7/139; 7/165; 7/167; 7/170; 59/7; 81/177.2; 81/177.4; 81/DIG. 7

[58] Field of Search ..... 7/138, 139, 165, 167, 7/170; 59/7; 81/DIG. 7, 121.1, 177.1, 177.2, 177.4, 180.1, 185.2, 129, 170

[56] References Cited

U.S. PATENT DOCUMENTS 3,370,307 2/1968 Beeks .
4,103,378 8/1978 Granados .
4,122,569 10/1978 Hitchcock .
4,221,113 9/1980 Jordan .
4,477,936 10/1984 Weston .

*Primary Examiner*—Roscoe V. Parker

[57] ABSTRACT

A bicycle tool kit which provides a small adjustable open end wrech with an elongated handle to which is affixed a chain link remover for repairing broken links of bicycle chains. The threaded shaft of the chain link remover is adapted for removably retaining a socket and two allen wrenches for adjustment of various hardware components of the bicycle. The jaws of the adjustable open end wrench are also adapted for adjusting the tension of the spokes of the bicycle wheels. The allen wrenches can be assembled onto the head of the adjustable open end wrench and the handle of the link remover in various positions to provide leverage for several repair applications of the device. Useful accessory tool heads are provided which can be gripped in the jaws of the adjustable open end wrench using the handle as a lever. The kit is compact and fits into a pocket sized carrying pouch.

11 Claims, 8 Drawing Sheets

MULTIPURPOSE BICYCLE TOOL KIT

BACKGROUND OF THE INVENTION

1. Field of the Invention

This invention relates to hand tools and more precisely to a multipurpose bicycle repair and maintenance tool kit. The present invention is a compact bicycle tool kit easily carried on the bike or by the rider for use if a breakdown occurs or an adjustment needs to be made on the road.

2. Description of Prior Art

Bicyclists have long been plagued with the problem of minor breakdowns occurring while riding when they are far from help or access to repair equipment. Because of the excess weight and limited storage space, conventional tools are seldom transported along with the bike for repair and adjustment purposes. The majority of problems occurring on conventional bicycles can be fixed or adjusted with only a few specific tools. Combining these specific tools into one lightweight compact unit would be particularly useful to the biker which is the purpose of the immediate invention.

A past art patent search was conducted at the U.S. Patent Office to examine kits and combination tools which included specific tools required for certain areas of bicycle repair. Most multipurpose tools and kits specifically for bicycle use appeared inadequate. Of those patents examined, the following were considered most pertinent to my invention: J. L. Weston was granted U.S. Pat. No. 4,477,936, on Oct. 23, 1984, for a multipurpose bicycle tool. Although this device contains several useful tools it does not contain a chain link remover which is vital for repairing a broken bike chain, nor does it contain any allen wrenches for seat adjustments. The patent issued to T. H. Hitchcock, U.S. Pat. No. 4,122,569, dated Oct. 31, 1978, teaches a universal tool having a variety of uses. However, the Hitchcock device also does not have a chain link remover. A tool similar to the Hitchcock and Weston devices was patented by R. L. Beeks, U.S. Pat. No. 3,370,307, dated Feb. 27, 1968. The chain link remover is again one of the necessary elements missing from this device to make it useful as a bicycle repair tool.

Several past art devices included tools primarily for removal of links from chains without including other tool combinations. Typical of these tools is the R. C. Jordan device, patented in the U.S. on Sep. 9, 1980, U.S. Pat. No. 4,221,113, and the tool shown in a U.S. patent issued to J. F. Granados, on Aug. 1, 1978, U.S. Pat. No. 4,103,378. Granados discloses a tool principally designed for chain breaking which also has tool parts for tightening wheel spokes and for trueing or dishing bicycle wheels.

None of the devices shown in past art patents included sufficient tools needed for most of the basic repair problems prevalent to bicycles. My device not only includes all the necessary tools but combines them into a compact and relatively lightweight portable kit sized to be carried in a pouch attached to the bicycle or by the bicycle rider.

SUMMARY OF THE INVENTION

In practicing my invention, I have provided a multipurpose bicycle tool kit useful during repair work on bicycles and for adjustment of bicycle parts. The kit according to the invention combines the bicycle oriented tools most often needed for field service work into a light weight kit easily carried in the pocket of a bicycle rider or attached to the bike in a pouch. Included in the kit is an adjustable open end narrow gauge wrench modified for specific bicycle uses such as spoke nipple and headset adjustments. The slopping narrowed jaws of the adjustable open end wrench make this an ideal tool for tightening pedals, miscellaneous nuts, brake pads, and wheel bearing cone adjusting. The kit also includes three sizes of allen wrenches useful for seat adjustment, brake lever location adjustment, brake cable length setting, shift mechanisms tuning, chain ring tightening, water bottle holder attachments, and handlebar raising and lowering. A Phillips screw driver is included for adjusting front and rear shifting mechanisms and the positioning of shift levers. The kit is structured so a single handle has a variety of uses for both tool attachment and for chain repair. Actually, the handle is equipped with complete chain repair capabilities. Most all tools needed to accomplish simple and easy field repair with correct tools are included in the kit. For use with the adjustable open end wrench, I provide tool heads with fittings which can be grasped in the adjustable wrench jaws and used as additional tools. A first tool head is a flat open end wrench sized for tightening and loosening the headset nut on the head tube of a bicycle just below the handlebars. Another tool head is a flattened hook-shaped wrench having a square tip angled back towards the opened hook area. This tool is particularly useful for grasping and rotating the bicycle bottom bracket retainer nut. A socket is also supplied with straight areas in the side wall so the jaws of the adjustable open end wrench can grip the socket and the wrench handle can be used as a "cheater" or driver for levering. Although the tool head accessories and the socket can be supplied in a variety of sizes, most bike owners need only one of each size in his kit which he selects for his particular bicycle. With the variety of tools incorporated into the basically single tool provided in the kit according to the invention, the cost of purchasing each tool separately is eliminated. The small size of the kit greatly reduces both weight factors and storage space requirements critical to bicyclists, especially during racing.

Therefore, a primary object of the invention is to provide a multipurpose bicycle tool kit in a single tool structure providing all the necessary tools for repairing the majority of the most commonly required field repairs needed on bicycles.

A further object of the invention is to provide a multipurpose bicycle tool kit which is lightweight, compact enough to require very little storage space, and does not add appreciably to the weight of the bicycle or the rider.

An even further object of the invention is to provide a multipurpose bicycle tool kit which is less expensive than the combined cost of the individual conventional tools this invention is designed to replace.

Further objects and advantages of the invention will become apparent with a reading of the remaining specification and subsequent comparison of described numbered parts with the same numbered parts illustrated in the accompanying drawings.

DESCRIPTION OF THE PREFERRED EMBODIMENT

Figure 1:
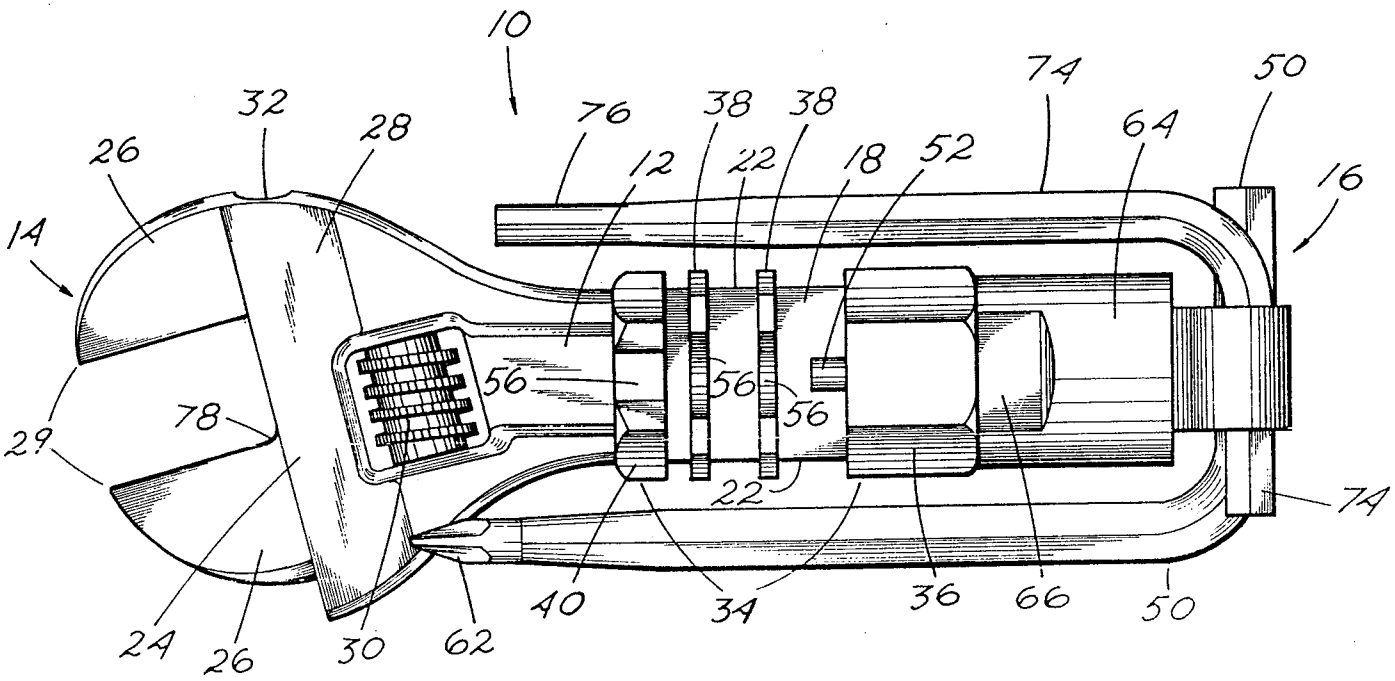
FIG. 1 is a top plan view of the assembled invention less auxiliary attachments.
Figure 2:
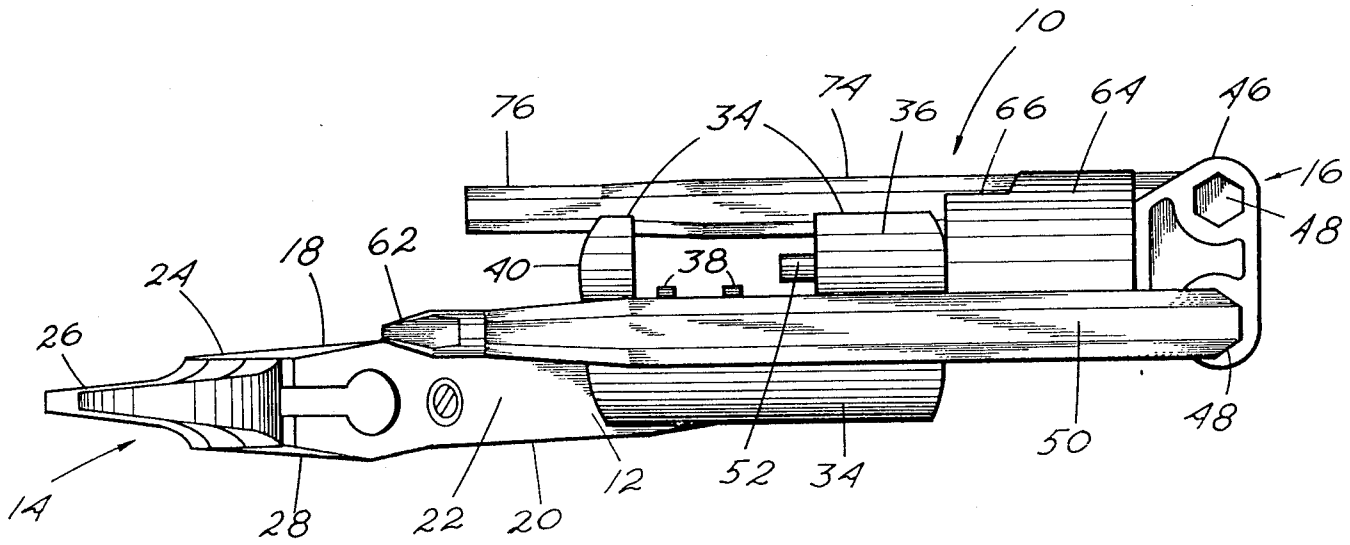
FIG. 2 is a side view of the FIG. 1 assemblage illustrating narrowing of the adjustable open end jaws for accessing restricted work areas.
Figure 3:
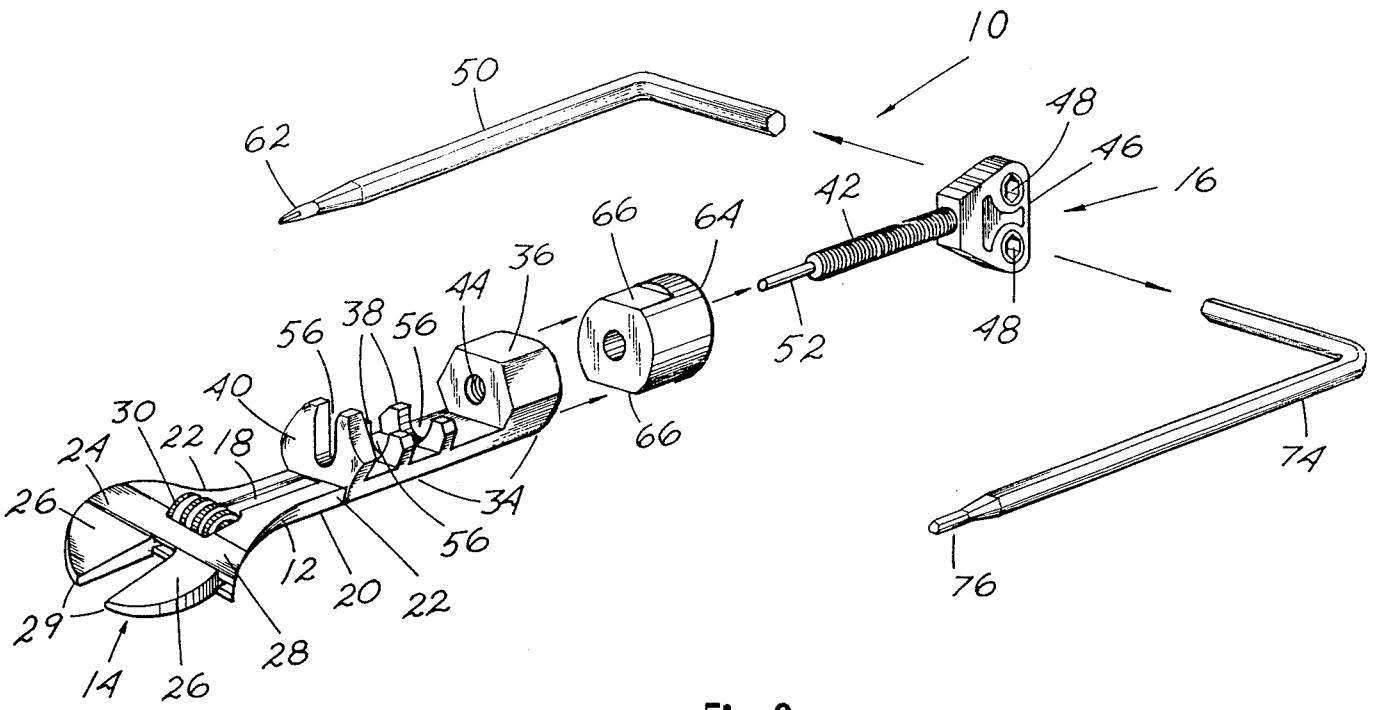
FIG. 3 is a perspective exploded view of component parts illustrating the multipurpose bicycle tool kit according to the invention. The adjustable open end wrench with inherent chain link remover handle shown left in the illustration followed right by the detached socket and threaded chain link remover pin and handle for the chain link remover. Positioned on either side of the chain link remover handle are the two allen wrenches. The foreground allen wrench is dual sized and the background allen wrench has a Phillips screwdriver tip at the long end.
Figure 4:
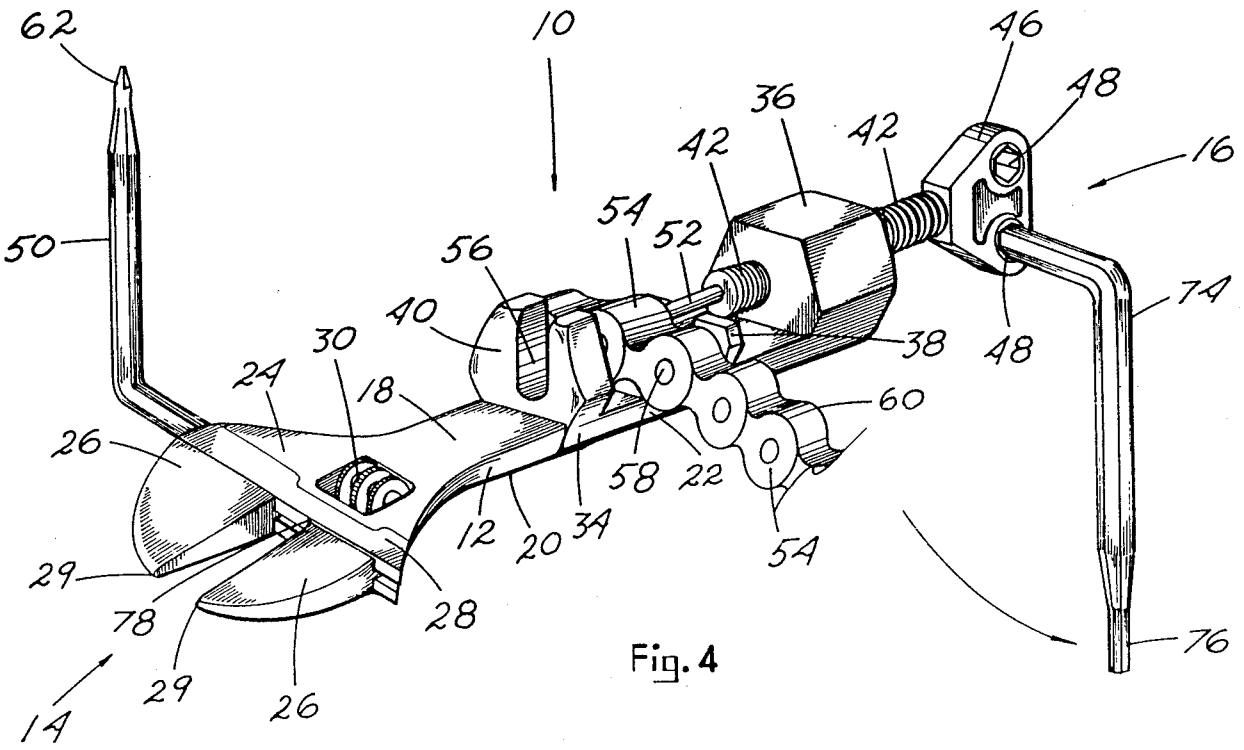
FIG. 4 is an in use illustration of the chain link remover disconnecting a link from a portion of a bicycle chain. The allen wrenches are used on either end for leverage.

Referring now to the drawings where the preferred embodiment of the invention, generally referred to as multipurpose bicycle tool kit 10, is illustrated in various views. Multipurpose bicycle tool kit 10 is comprised of a flat elongated handle 12 having a first end 14, a second end 16, a flat top surface 18, a flat bottom surface 20, and two narrow lateral angled sides 22. Inherently attached to first end 14 of handle 12 is the head of a small modified adjustable open end wrench 24, illustrated in all figures. Jaws 26 are narrow gauge, slopping from a wide affixment in jaw support structure 28 to narrow jaw gripper ends 29 with at least one of jaws 26 being mobile and the opening between jaws 26 being adjustable by finger-turned jaw opening adjuster 30. The top surface 18 of handle 12 is inherently affixed with chain link remover 34. Chain link remover 34 comprises shaft guide head 36, two link support members 38, anvil 40, and link ejector rod 52. Shaft guide head 36 is a short widened hexagon shaped base section having a flat vertical front end and a flat vertical back end which is opened in the middle through both ends by central threaded bore 44. A threaded shaft 42 useful as a chain link pin 58 remover can be screwed in and out through central threaded bore 44. Link support members 38 are U-shaped and sized to fit and retain links of bicycle chain 54 for chain link pin 58 removal which are pushed out through anvil 40 during bicycle chain repairs. Shaft guide head 36 is positioned adjacent second end 16 of handle 12 and central threaded bore 44 sized for receiving threaded shaft 42 passes through shaft guide head 36 as best illustrated in FIG. 3. Threaded shaft 42 is an elongated cylindrical threaded rod attached to finger grip member 46, a generally triangular handle head useful for screwing threaded shaft 42 in and out of central threaded bore 44 during chain work. Finger grip member 46 has two apertures 48 cut through its wider surfaces. Apertures 48 are each sized for releasably receiving one allen wrench 50 and one small sized allen wrench 74. The opposite end of threaded shaft 42 is affixed with link ejector rod 52, as seen in FIG. 3 and 4. Link ejector rod 52 is a short cylindrical rod shaped into the terminal free end of threaded shaft 42 sized smaller in diameter than threaded shaft 42. Positioned adjacent to shaft guide head 36, on top surface 18, are both link support members 38. Each link support member 38 has short narrow walls and is generally U-shaped with the U forming a concaved center. The sides of link support members 38 are angled similar to shaft guide head 36. Both link support members 38 are sufficiently spaced apart for securely receiving a portion of bicycle chain 54. Positioned next to link support members 38 towards first end 14 is anvil 40. Anvil 40 is equal in diameter to shaft guide head 36 but is much narrower in width, as shown in all Figures. The sides of anvil 40 are also angled like shaft guide head 36. Anvil 40 contains a vertical slot 56, best shown in FIG. 4, sized for passage of link pin 58 of bicycle chain 54. The two allen wrenches previously mentioned, allen wrench 50 and small sized allen wrench 74, are modified allen wrenches provided in sizes normally useful on bicycle fittings. Both allen wrenches are removably retained in apertures 48 in triangular finger grip member 46. One allen wrench 50 has a distal end affixed with a Phillips screwdriver 62, the other, allen wrench 74, is smaller in size and has the distal end shaped into a further reduced size allen wrench 76. Although not shown, one arm of either allen wrench could be affixed with a flat bladed screwdriver. Socket 64 is a socket ordinarily used with a driver as a socket wrench. Socket 64 is supplied in a size normally used to fit attachments on a bicycle. Modifications to socket 64 for purposes of this kit include two oppositely positioned socket flat wall surfaces 66 in the exterior wall of socket 64 giving jaws 26 of adjustable open end wrench 24 a positive gripping surface on socket 64 for using adjustable open end wrench 24 as a driver handle and socket 64 as a socket wrench. The interior bore of socket 64 is cut clear through and sized for sliding socket 64 over threaded shaft 42 for storage.

To use chain link remover 34 for extracting link pin 58 from bicycle chain 54, all parts are disassembled from handle 12. Threaded shaft 42 is partially reinserted into central threaded bore 44 of shaft guide head 36, as shown in FIG. 4. The section of bicycle chain 54 with the broken link 60 is placed transversely over top surface 18 of handle 12 between link support members 38, aligning link pin 58 with link ejector rod 52. The user grasps finger grip member 46 and rotates threaded shaft 42 clockwise advancing link ejector rod 52 towards first end 14 until the distal end of link ejector rod 52 forces link pin 58 out of attachment with bicycle chain 54. Bicycle chain 54 is repositioned and the second link pin 58 is removed, freeing the broken link 60 from bicycle chain 54. A replacement link 60 is then added if required.

Figure 5:
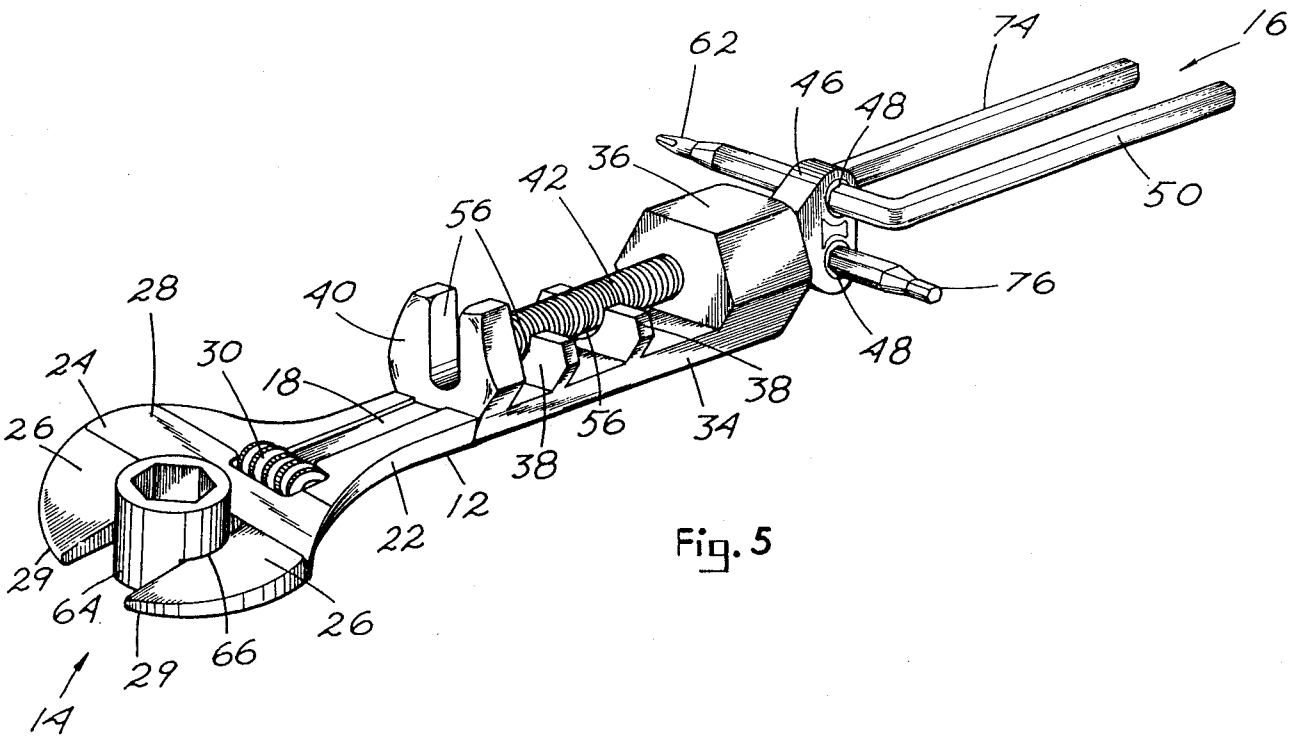
FIG. 5 is a perspective view of the multipurpose bicycle tool kit according to the invention assembled to show a suggested positioning of parts for using the adjustable open end wrench jaws for holding a socket wrench as a driver.

To utilize socket 64, all parts are disassembled and socket 64 is positioned between opposing jaws 26 aligning socket flat wall surfaces 66 with the flat adjacent edges of jaws 26, which prevents rotation of socket 64. To extend the length of handle 12 and increase leverage, threaded shaft 42 is fully inserted into central threaded bore 44 of shaft guide head 36 and both allen wrenches 50 and 74 inserted into apertures 48 with the longest sections of allen wrenches 50 and 74 projecting rearward in straight alignment with handle 12, as shown in FIG. 5. It is noted that apertures 48 are shaped to retain allen wrenches 50 and 74 in fixed positions relative to handle 12. For other levering, allen wrench 50 can also be inserted into aperture 32 in the top of jaw support structure 28 of jaws 26. Of particular note is that at least one of the two opposing jaws 26 of adjustable open end wrench 24 is modified with curve 78 adjacent jaw support structure 28 which is designed to fit and grasp bicycle spoke nipple 80 at the base of bicycle spoke 82 for adjusting spoke tension.

Figure 7:
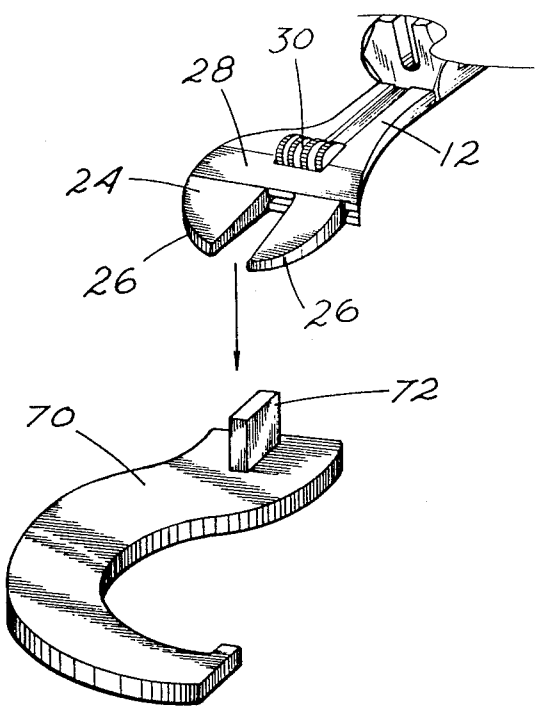
FIG. 7 is a perspective view of an accessory tool head having a surface fixture useful for grasping in the jaws of the adjustable open end wrench and using the adjustable wrench as a handle. The accessory tool of FIG. 7 is a flat hook-shaped wrench having a square tip angled back towards the opened hook area. This tool is particularly useful for removal and replacement of the bicycle bottom bracket retainer nut.
Figure 6:
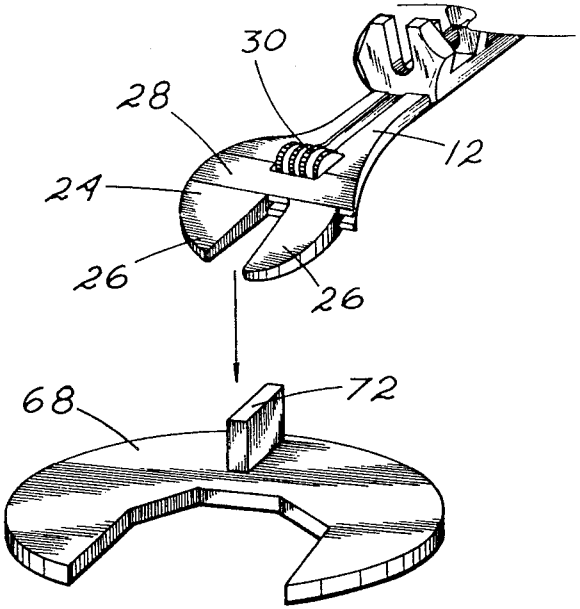
FIG. 6 is a perspective view of an accessory tool head having a surface fixture useful for grasping in the jaws of the adjustable open end wrench and using the adjustable wrench as a handle. The accessory tool of FIG. 6 is a flat open end wrench sized for tightening and loosening the headset nut on the head tube of a bicycle just below the handlebars.
Figure 8:
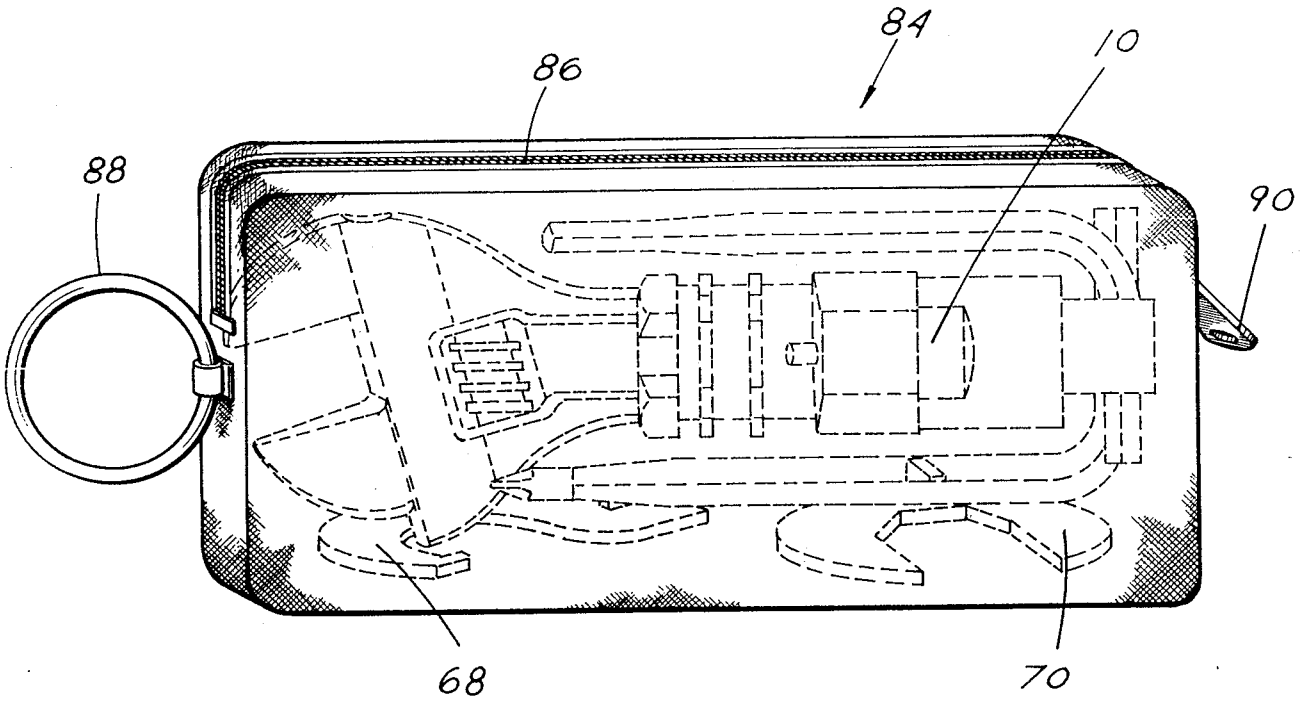
FIG. 8 illustrates a carrying pouch useful with the immediate invention and accessory parts. The invention and the accessory parts are shown as dotted lines relatively positioned inside the carrying pouch.
Figure 9:
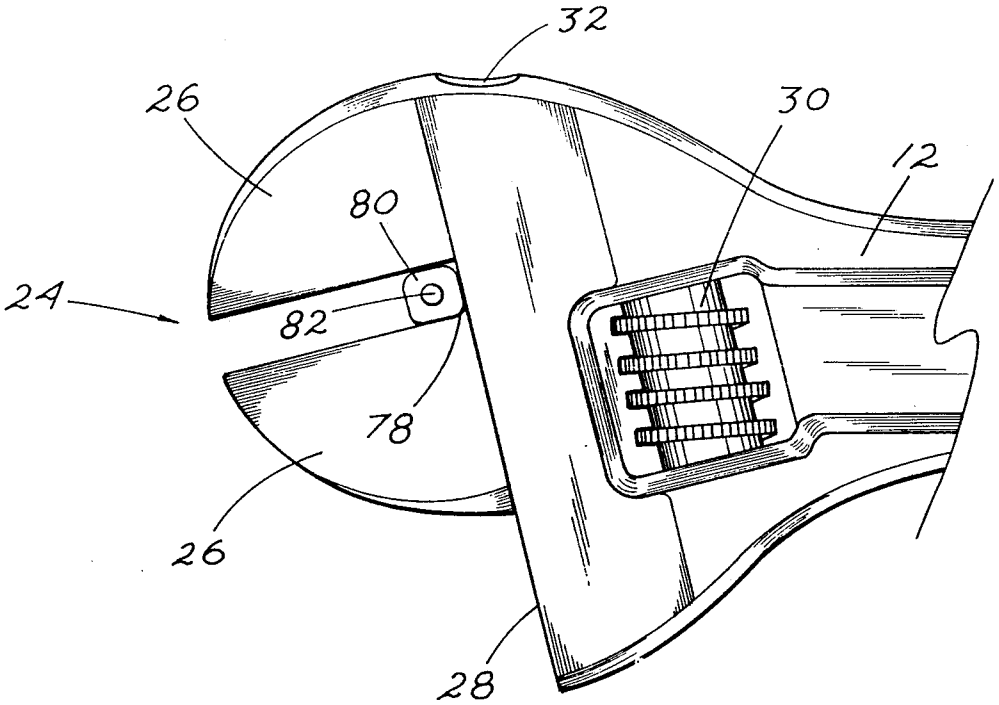
FIG. 9 is a partial view of the invention showing the opposing jaws of the adjustable open end wrench clamped onto a bicycle spoke nipple for adjusting spoke tension. An inner curve in the lower jaw clamping surface is illustrated fitting a curved corner of the bicycle spoke nipple.

The component parts of this invention are specifically selected and sized for making repairs and adjustments for the most common of bicycle breakdowns. For example, a full assortment of sockets 64 is not required since the most common of adjustments on the bicycle will only require a single size socket 64. For odd nut adjustments, adjustable open end wrench 24 is available. This particular basic combination of tools is crucial to the effectiveness of this invention as an all-around multipurpose bicycle tool kit. Elimination of parts would leave the kit incomplete, although addition of accessory parts would be convenient it would also prove more cumbersome to transport. Two small optional accessory parts are illustrated and described herein for less frequently occurring break downs and adjustments. The first accessory part being headset wrench 68, a flat open end wrench head with gripping tab 72 on the surface for use with adjustable open end wrench 24. Headset wrench 68 is illustrated in FIG. 6. Headset wrench 68 is provided as a tool for tightening and loosening the headset nut on the head tube of a bicycle just below the handlebars. Although headset wrench 68 is available in different jaw sizes to fit different sized bicycle headset nuts, for kit compaction, it is suggested that the individual rider select the size useful for his particular headset. A second accessory part is bracket bearing wrench 70, a hook-shaped wrench head having a square tip angled back towards the opened hook area, provided for removal and replacement of the bicycle bottom bracket retainer nut. Bracket bearing wrench 70 also has gripping tab 72 protruding from a plainer surface for use with jaws 26 of adjustable open wrench 24. See FIG. 7. The accessory parts, headset wrench 68 and bracket bearing wrench 70, can be included with the bicycle tool kit 10 in carrying pouch 84 as illustrated in FIG. 8. Carrying pouch 84 can be opened for interior access and the opening secured in a closed position by pulling zipper pull tab 90. Carrier ring 88 is illustrative of a carrying attachment for carrying pouch 84. Carrying pouch 84 is preferably provided with multipurpose bicycle tool kit 10 to prevent loss of accessory parts and of kit parts should they become disassembled.

The novelty of the immediate invention is that the most utilized tools for bicycle repair are provided in a multipurpose bicycle tool kit 10 attached to and useful with a single handle 12. The entire multipurpose bicycle tool kit 10 without carrying pouch 84 can easily be carried by the rider and the excess weight is negligible compared to the combined weight of the same individual conventional tools. Although carrying pouch 84 is preferred, it is not essential to the functional purpose of multipurpose bicycle tool kit 10 except for containment of accessory attachments headset wrench 68 and bracket bearing wrench 70. A carrying pouch 84, however, even with accessory tools 68 and 70 included, is still quite compact and can be conveniently attached to the frame of a bicycle, worn on a rider's belt, or carried in a rider's pocket if he has one.

Having thus identified and described a preferred tool combination in the specification and illustrated it in the drawings for multipurpose bicycle tool kit 10 according to the invention, it is to be understood that this is for illuminating the invention only and not intended to limit modifications to the invention which I may elect to make so long as any modifications made remain within the intended scope of the appended claims, and I will consider modifications made by others to the invention which fall within my claim scope to be my invention.

What I claim is:

1. A multipurpose bicycle tool kit comprising in combination:

a handle;

said handle having a first end, a second end, a top surface, a bottom surface, and lateral sides;

an adjustable open end wrench extending from said first end of said handle;

said adjustable open end wrench having two opposing jaws affixed in a jaw support structure with at least one of said jaws mobile;

a jaw opening adjuster for manually setting the opening distance between said opposing jaws;

an aperture in an end of said jaw support structure providing an opening into a shallow longitudinal bore;

a bicycle chain link remover structured in said top surface of said handle;

said bicycle chain link remover including a shaft guide head, at least one link support member, an anvil, and a threaded shaft formed into a link ejector rod at one end and being adapted for screw adjustment by manual rotation of a finger grip member affixed at an opposite end with said screw adjustment provided by a threaded bore centrally passaged through said shaft guide head, said shaft guide head adapted to align said link ejector rod with slot openings in said at least one link support member and said anvil;

said finger grip member being terminally positioned at said second end of said handle;

said finger grip member having at least two apertures through opposite flat sides sized to removably accept at least two different sized allen wrenches and to maintain said at least two different sized allen wrenches in fixed positions;

said at least two different sized allen wrenches each structured at one terminal end into a secondary tool;

a socket;

said socket sized for fittings normal to bicycles;

said socket adapted by oppositely positioned flat side wall sections for positive gripping by said jaws of said adjustable open end wrench providing use of said handle as a driver handle with said socket useful as a levered socket wrench;

said socket having an interior bore opened therethrough adapting said socket for slide over storage on said threaded shaft of said bicycle chain link remover.

2. The multipurpose bicycle tool kit of claim 1 wherein said at least two different sized allen wrenches each structured at one terminal end into a secondary tool, said secondary tool on at least one of said allen wrenches being a Phillips screwdriver.

3. The multipurpose bicycle tool kit of claim 1 wherein said at least two different sized allen wrenches each structured at one terminal end into a secondary tool, said secondary tool on at least one of said allen wrenches being a reduce sized allen wrench.

4. The multipurpose bicycle tool kit of claim 1 wherein said Jaws are narrowed gauge, slopping from a wide affixment in said jaw support structure with said jaws narrowed at terminal ends.

5. A multipurpose bicycle tool kit comprising in combination:

a handle;

said handle having a first end, a second end, a top surface, a bottom surface, and lateral sides;

an adjustable open end wrench extending from said first end of said handle;

said adjustable open end wrench having two opposing jaws affixed in a jaw support structure with at least one of said jaws mobile;

a jaw opening adjuster for manually setting the opening distance between said opposing jaws;

an aperture in an end of said jaw support structure providing an opening into a shallow longitudinal bore;

a bicycle chain link remover structured in said top surface of said handle;

said bicycle chain link remover including a shaft guide head, at least one link support member, an anvil, and a threaded shaft formed into a link ejector rod at one end and being adapted for screw adjustment by manual rotation of a finger grip member affixed at an opposite end with said screw adjustment provided by a threaded bore centrally passaged through said shaft guide head, said shaft guide head adapted to align said link ejector rod with slot openings in said at least one link support member and said anvil;

said finger grip member being terminally positioned at said second end of said handle;

said finger grip member having at least two apertures through opposite flat sides sized to removably accept at least two different sized allen wrenches and to maintain said at least two different sized allen wrenches in fixed positions;

said at least two different sized allen wrenches each structured at one terminal end into a secondary tool;

a socket;

said socket sized for fittings normal to bicycles;

said socket adapted by oppositely positioned flat side wall sections for positive gripping by said jaws of said adjustable open end wrench providing use of said handle as a driver handle with said socket useful as a levered socket wrench;

said socket having an interior bore opened therethrough adapting said socket for slide over storage on said threaded shaft of said bicycle chain link remover;

said multipurpose bicycle tool kit adapted for portability and accessory tool storage by removable containment in a carrying pouch.

6. The multipurpose bicycle tool kit of claim 5 wherein said carrying pouch is internally accessible through an opening with edges of said opening having attachment mechanics allowing internal pouch access through said opening and releasable secured closing of said opening.

7. A multipurpose bicycle tool kit comprising in combination:

a handle;

said handle having a first end, a second end, a top surface, a bottom surface, and lateral sides;

an adjustable open end wrench extending from said first end of said handle;

said adjustable open end wrench having two opposing jaws affixed in a jaw support structure with at least one of said jaws mobile;

a jaw opening adjuster for manually setting the opening distance between said opposing jaws;

an aperture in an end of said jaw support structure providing an opening into a shallow longitudinal bore;

a bicycle chain link remover structured in said top surface of said handle;

said bicycle chain link remover including a shaft guide head, at least one link support member, an anvil, and a threaded shaft formed into a link ejector rod at one end and being adapted for screw adjustment by manual rotation of a finger grip member affixed at an opposite end with said screw adjustment provided by a threaded bore centrally passaged through said shaft guide head, said shaft guide head adapted to align said link ejector rod with slot openings in said at least one link support member and said anvil;

said finger grip member being terminally positioned at said second end of said handle;

said finger grip member having at least two apertures through opposite flat sides sized to removably accept at least two different sized allen wrenches and to maintain said at least two different sized allen wrenches in fixed positions;

said at least two different sized allen wrenches each structured at one terminal end into a secondary tool;

a socket;

said socket sized for fittings normal to bicycles;

said socket adapted by oppositely positioned flat side wall sections for positive gripping by said jaws of said adjustable open end wrench providing use of said handle as a driver handle with said socket useful as a levered socket wrench;

said socket having an interior bore opened therethrough adapting said socket for slide over storage on said threaded shaft of said bicycle chain link remover.

said multipurpose bicycle tool kit adapted for portability and accessory tool storage by removable containment in a carrying pouch;

said accessory tools being practicable head portions adapted by surface structure for gripping by said jaws of said adjustable open end wrench providing additional tooling functions to said handle.

8. The multipurpose bicycle tool kit of claim 7 wherein said accessory tools include a headset wrench, said headset wrench being a flat open end wrench sized for tightening and loosening the headset nut on the head tube of a bicycle just below the handlebars.

9. The multipurpose bicycle tool kit of claim 7 wherein said accessory tools include a bracket bearing wrench, said bracket bearing wrench being a flat hook-shaped wrench having a square tip angled back towards the opened hook area useful for removal and replacement of the bicycle bottom bracket retainer nut.

10. The multipurpose bicycle tool kit of claim 7 wherein said accessory tools being practicable head portions adapted by surface structure for gripping by said jaws, said surface structure being each of said accessory tools, said head portions, having a protruding tab on at least one plainer surface of said each of said head portions of said tools with said protruding tab sized for said gripping by said jaws and providing said tool head portions useful security for use as a tool with said handle providing a handle for said tool use.

11. A multipurpose bicycle tool kit comprising in combination:

a handle;

said handle having a first end, a second end, a top surface, a bottom surface, and lateral sides;

an adjustable open end wrench extending from said first end of said handle;

said adjustable open end wrench having two opposing jaws affixed in a jaw support structure with at least one of said jaws mobile;

a jaw opening adjuster for manually setting the opening distance between said opposing jaws;

an aperture in an end of said jaw support structure providing an opening into a shallow longitudinal bore;

at least one of said two opposing jaws of said adjustable open end wrench having a small curve in a clamping surface adjacent said jaw support structure sized for fit a rounded corner of a bicycle spoke nipple;

a bicycle chain link remover structured in said top surface of said handle;

said bicycle chain link remover including a shaft guide head, at least one link support member, an anvil, and a threaded shaft formed into a link ejector rod at one end and being adapted for screw adjustment by manual rotation of a finger grip member affixed at an opposite end with said screw adjustment provided by a threaded bore centrally passaged through said shaft guide head, said shaft guide head adapted to align said link ejector rod with slot openings in said at least one link support member and said anvil;

said finger grip member being terminally positioned at said second end of said handle;

said finger grip member having at least two apertures through opposite flat sides sized to removably accept at least two different sized allen wrenches and to maintain said at least two different sized allen wrenches in fixed positions;

said at least two different sized allen wrenches each structured at one terminal end into a secondary tool;

a socket;

said socket sized for fittings normal to bicycles;

said socket adapted by oppositely positioned flat side wall sections for positive gripping by said jaws of said adjustable open end wrench providing use of said handle as a driver handle with said socket useful as a levered socket wrench;

said socket having an interior bore opened therethrough adapting said socket for slide over storage on said threaded shaft of said bicycle chain link remover.

* * * * *